US005815785A

United States Patent [19]

Bares et al.

[11] Patent Number: 5,815,785

[45] Date of Patent: Sep. 29, 1998

[54] METHOD AND APPARATUS FOR MIXED COLOR TONERS SEPARATION AND RECOVERY

[75] Inventors: Jan Bares, Webster; Nero R. Lindblad, Ontario, both of N.Y.

[73] Assignee: Xerox Corporation, Stamford, Conn.

[21] Appl. No.: 785,110

[22] Filed: Jan. 21, 1997

[51] Int. Cl.[6] ..... G03G 21/10

[52] U.S. Cl. ..... 399/358

[58] Field of Search ..... 399/358, 359, 399/360

[56] References Cited

U.S. PATENT DOCUMENTS

| | | | |
|---|---|---|---|
| 4,078,929 | 3/1978 | Grundlach | 430/42 |
| 5,010,367 | 4/1991 | Hays | 399/266 |
| 5,272,510 | 12/1993 | Reese et al. | 399/385 |

*Primary Examiner*—S. Lee
*Attorney, Agent, or Firm*—Tallam I. Nguti

[57] ABSTRACT

Apparatus and method for separating and recovering separately toner particles of one matchable characteristic different color toner contained in a mixture of a plurality of such different color toners. The apparatus and method include a holder for holding a quantity of the mixture of a plurality of such different color toners, and a selected particular type of carrier beads characteristically matching, and being more likely to charge, attract and triboelectrically bind with, toner particles of a matching color toner in the mixture of the different color toners than with toner particles of any other color toner therein. The apparatus and method also include a blending device for forming, in the holder an admixture of a quantity of the mixture of the different color toners and a quantity of the selected particular type of carrier beads such that the admixture has a toner coated carrier phase and a loose toner particles phase, and such that the toner coated carrier phase consists of the selected particular type of carrier beads coated with toner particles of the matching one color toner of the different color toners of the admixture. The apparatus and method further include separating mechanisms for separating the toner coated phase from the loose toner particles phase, and a recovery mechanism for separating and removing, from the coated selected particular type of carrier beads of the toner coated phase, the toner particles of the matching one color toner.

12 Claims, 6 Drawing Sheets

METHOD AND APPARATUS FOR MIXED COLOR TONERS SEPARATION AND RECOVERY

BACKGROUND OF THE INVENTION

This invention relates generally to electrostatographic color reproduction processes, and more particularly concerns a method and apparatus for separating and recovering, as in a mixed toner recycling operation, different color toners from a mixture of such toners that are removed, for example, at a common cleaning station of an electrostatographic color machine.

In the process of electrostatographic printing, a photoconductive surface is charged to a substantially uniform potential. The photoconductive surface is imagewise exposed to record an electrostatic latent image corresponding to the informational areas of an original document being reproduced. Alternatively, a light beam, such as a laser beam may be modulated to expose the charged portion of a photoconductive surface selectively, thereby recording a latent image thereon. In either case, information is recorded as an electrostatic latent image on the photoconductive surface. Thereafter, a developer material is transported into contact with the electrostatic latent image. Typical developer materials include carrier granules having toner particles adhering triboelectrically thereto. The toner particles are attracted from the carrier granules of the developer material onto the latent image. The resultant toner powder image is then transferred from the photoconductive surface to a sheet and permanently affixed thereto. The foregoing generally describes a typical mono-color electrostatographic color reproduction machine.

Recently, electrostatographic color reproduction machines had been developed which produce highlight color copies. A typical highlight color reproduction machine records successive electrostatic latent images on the photoconductive surface. When combined, these electrostatic latent images form a latent image corresponding to the entire original document being printed. One latent image is usually developed with black toner particles. The other latent image is developed with color highlighting toner particles, e.g. red toner particles. These developed toner powder images are transferred sequentially to a sheet to form a color highlighted document. A color highlighting color reproduction machine of this type is a two-pass machine. Single pass highlight color reproduction machines using tri-level printing have also been developed. Tri-level electrostatographic printing is described in greater detail in U.S. Pat. No. 4,078,929. As described in this patent, the latent image is developed with toner particles of first and second colors. The toner particles of one of the colors are positively charged and the toner particles of the other color are negatively charged.

In one embodiment, the toner particles are supplied by a developer which comprises a mixture of triboelectrically relatively positive and relatively negative carrier beads. The carrier beads support, respectively, relatively negative and relatively positively charged toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image and improves color sharpness.

In tri-level electrostatographic printing, the charge on the photoconductive surface is divided in three, rather than two, ways as is the case in mono-color printing. The photoconductive surface is charged and exposed imagewise such that one image corresponds to the charged areas and remains at the full charged potential. The other image, which corresponds to discharged image areas, is exposed to discharge the photoconductive surface to its residual potential. The background areas are exposed to reduce the photoconductive surface potential to about halfway between the charged and discharged potentials. A developer unit arranged to develop the charged images is typically biased to a potential between the background potential and the full potential. The developer unit, arranged to develop the discharged imaged areas, is typically biased to a level between the background potential and the discharged potential. The single pass nature of this system dictates that the electrostatic latent image passes through the developer unit in a serial fashion.

Another type of color reproduction machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and imagewise exposed to record the highlight color portions of the latent image thereon. A highlight latent image is then developed with toner particles of a color other than black, e.g. red then develop the highlight latent image. Thereafter, both toner powder images are transferred to a sheet and subsequently fused thereto to form a highlight color document.

In order to clean and prepare each surface section of the photoconductive member for another imaging cycle as described above, usually a single cleaning device is used to mixedly remove residual toner particles of both colors from such section.

U.S. Pat. No. 5,010,367 describes a development system employing electrode wires disposed in the development zone between the donor roller and the photoconductive surface. Toner particles are transported by the donor roller to the development zone. The electrode wires are electrically biased to detach toner particles from the donor roll forming a toner powder cloud in the development zone. Toner particles from the toner powder cloud develop the electrostatic latent image recorded on the photoconductive surface. A single cleaning device mixedly removes residual particles of the first and the second color toners from the photoconductive surface for subsequent disposal.

Typically, the mixture of first and second color residual toner particles as removed is received and contained for example in a waste toner container or other type of customer replaceable unit (CRU) for subsequent recycling, if possible, or disposal. In full color or process color machines, such CRU's or waste toner containers include a mixture of at least two different color residual toners, and up to four. Any attempt to reclaim and recycle the different color toners mixed therein must therefore be preceded by separation by colors. Ordinarily therefore, it has been difficult to recycle such mixtures of two or more different color toners, because of a lack of simple suitable apparatus for effecting such initial separation by colors.

SUMMARY OF THE INVENTION

In accordance with one aspect of the present invention, there is provided an apparatus and method for separating and recovering separately toner particles of one matchable characteristic different color toner contained in a mixture of a plurality of such different color toners. The apparatus and method include a holder for holding a quantity of the mixture of a plurality of such different color toners, and a selected particular type of carrier beads characteristically matching, and being more likely to charge, attract and triboelectrically bind with, toner particles of a matching color toner in the mixture of the different color toners than with toner particles of any other color toner therein. The apparatus and method also include a blending device for forming, in the holder, an admixture of a quantity of the mixture of the different color toners and a quantity of the selected particular type of carrier beads such that the admixture has a toner coated carrier phase and a loose toner particles phase, and such that the toner coated carrier phase consists of the selected particular type of carrier beads coated with toner particles of the matching one color toner of the different color toners of the admixture. The apparatus and method further include separating mechanisms for separating the toner coated phase from the loose toner particles phase, and a recovery mechanism for separating and removing, from the coated selected particular type of carrier beads of the toner coated phase, the toner particles of the matching one color toner.

In accordance with another aspect of the present invention, there is provided an electrostatographic multicolor reproduction machine including a mixed color toner separation and recovery apparatus. The multicolor reproduction machine includes at least two development stations each containing toner particles of a different color for developing multicolor toner images; an image bearing surface for holding the multicolor toner images; a cleaning device for removing residual toner particles of at least two different types of color toners from the image bearing surface; and a two stage mixed color toners separation and recovery apparatus. Each stage of the mixed color toners separation and recovery apparatus includes a housing defining channels for holding material, a particular type of magnetic carrier beads matching, and being more likely to charge, attract and triboelectrically bind with, toner particles of a matching color toner in the mixture of the different color toners than with toner particles of any other color toner. Each stage also includes augers for forming, in the channels, an admixture of a quantity of the mixture of the different color toners and a quantity of the particular type of magnetic carrier beads in the channel, such that the admixture has a toner coated carrier phase and a loose toner particles phase, and such that the toner coated carrier phase consists of the particular type of magnetic carrier beads in the channel coated with toner particles of the matching one color toner of the different color toners of the admixture. Each stage further includes a magnetic mechanism and gentle flowing air for separating the toner coated carrier phase from the loose toner particles phase of the admixture, and a recovery mechanism for separating and removing, from the coated particular type of magnetic carrier beads of the toner coated carrier phase, the toner particles of the matching one color toner.

BRIEF DESCRIPTION OF THE DRAWINGS

Other aspects of the present invention will become apparent as the following description proceeds and upon reference to the drawings in which.

DETAILED DESCRIPTION OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 6:
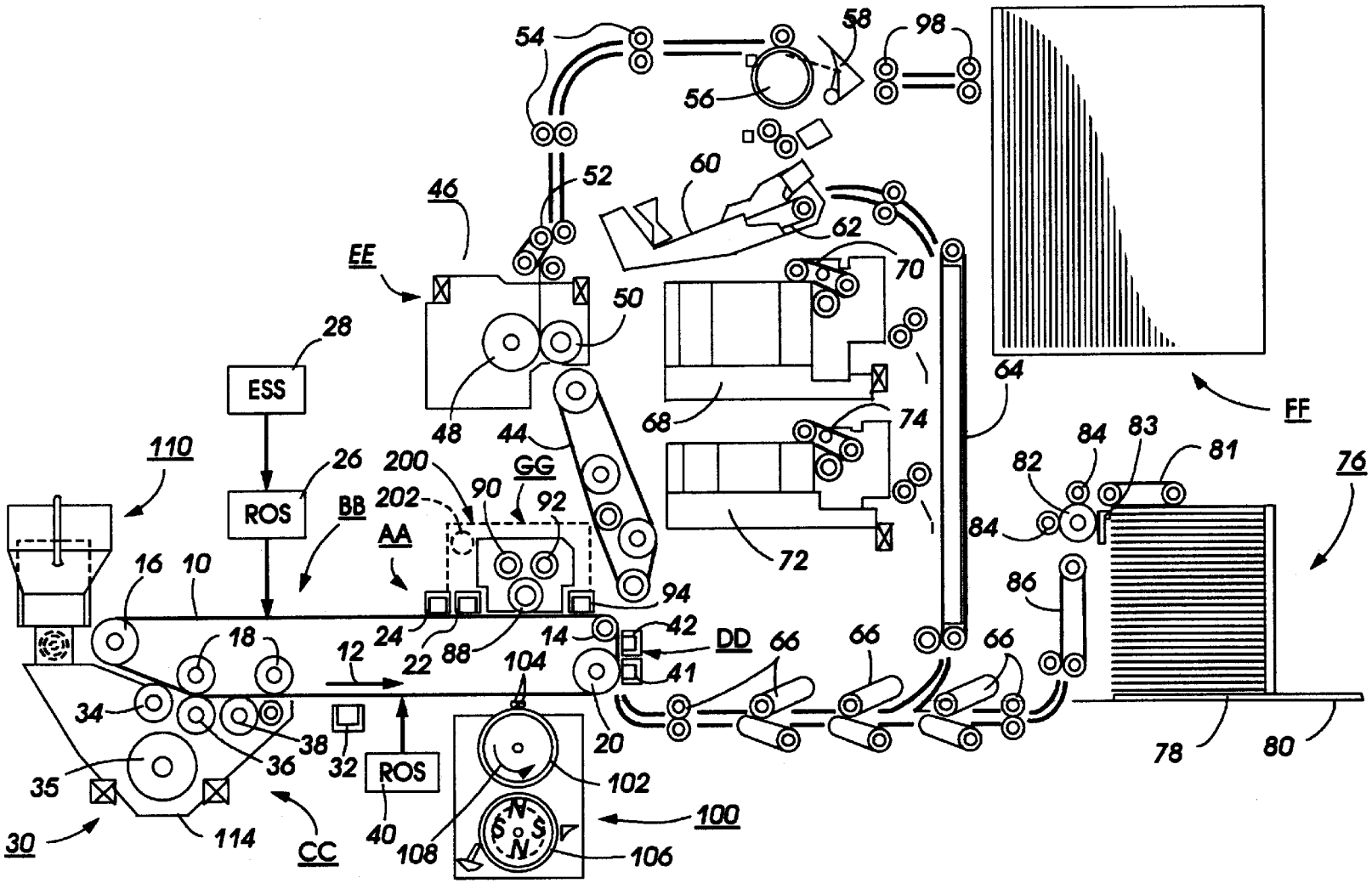
FIG. 6 is a schematic elevational view depicting an illustrative electrostatographic color reproduction machine including the mixed color toner separation and recovery apparatus of the present invention.

For a general understanding of the features of the present invention, reference is made to FIG. 6 which schematically depicts an electrostatographic color reproduction machine 8 incorporating the features of the present invention therein. It will become evident from the following discussion that the features of the present invention may be used in a wide variety of production machines or toner recycling plants, and is not specifically limited in this application to the particular embodiment depicted herein.

The electrostatographic color reproduction machine 8 employs a photoconductive belt 10. Preferably, the photoconductive belt 10 is made from a photoconductive material coated on a ground layer, which, in turn, is coated on anti-curl backing layer. The photoconductive material is made from a transport layer coated on a generator layer. The transport layer transports positive charges from the generator layer. The interface layer is coated on the ground layer, and the transport layer preferably contains small molecules of di-m-tolydiphenydiphenylbithenyldiamine dispersed in a polycarbonate. The generation layer is made from trigonal selenium. The grounding layer is made from a titanium coated mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station M. At charging station M, two corona generating devices, indicated generally by the reference numerals 22 and 24, charge photoconductive belt 10 to a relatively high, substantially uniform potential. Corona generating device 22 places all the required charge on photoconductive belt 10. Corona generating device 24 acts as leveling device, and fills in any areas missed by corona generating device 22.

Next, the charged portion of the photoconductive surface is advanced through imaging station BB. At imaging station BB, the uniformly charged photoconductive surface is exposed by an imager, such as a laser based input and/or output scanning device 26, which causes the charged portion of the photoconductive surface to be discharged in accordance with the output from the scanning device. The scanning device is a laser raster output scanner (ROS). The ROS performs the function of creating the output image copy on the photoconductive surface. It lays out the image in a series of horizontal scan lines with each line having a certain number of pixels per inch. The ROS may include a laser with rotating polygon mirror blocks and a suitable modulator or, in lieu thereof, a light emitting diode array (LED) as a write bar.

An electronic subsystem (ESS) 28 is the control electronics which prepares and manages the image data flow between the data source and the ROS. It may also include a display, user interface and electronic storage, i.e. memory, functions. The ESS is actually a self-contained, dedicated mini computer. The photoconductive surface, which is initially charged to a high charge potential, is discharged imagewise in the background areas and remains charged in the image areas in the black parts of the image.

At development station CC, a magnetic brush development system, indicated generally by the reference numeral 30 advances developer material into contact with the electrostatic latent image. The development system comprises three magnetic brush developer rollers, indicated generally by the reference numerals 34, 36 and 38. A paddle wheel 35 picks up developer material from developer sump 114 and delivers it to the developer rollers. When developer material reaches rolls 34 and 36, it is magnetically split between the rolls with half of the developer material being delivered to each roll. Photoconductive belt 10 is partially wrapped about rolls 34 and 36 to form extended development zones.

Developer roll 38 is a magnetic clean-up roll positioned after developer roll 36, in the direction of arrow 12, and operates as a carrier granular removal device adapted to remove any carrier granules adhering to belt 10. Thus, rolls 34 and 36 advance developer material into contact with the electrostatic latent image. The latent image attracts toner particles from the carrier granules of the developer material to form a developed toner powder image on the photoconductive surface of belt 10. Toner dispenser 110 discharges unused toner particles into sump 114. Developer rolls 34 and 36 are substantially identical.

Each of the foregoing developer rollers include a rotating sleeve having a stationary magnetic disposed interiorly thereof. The magnetic field generated by the magnet attracts developer material from paddle wheel 35 to the sleeve of the developer roller. As the sleeve rotates, it advances the developer material into the development zone where toner particles were attracted from the carrier granules to the charged area latent image. In this way, the charged area latent image is developed with these toner or marking particles. The toner particles being employed in developer unit 30 are black. Thus, the charged area latent image is developed by developer unit 30 with black toner particles. The black developed latent image continues to advance with photoconductive belt 10 in the direction of arrow 12.

Corona generator 32 recharges photoconductive surface of belt 10. A second imager, such as ROS 40, which may for example be an LED bar, illuminates the recharged photoconductive surface to selectively discharge the photoconductive surface. The photoconductive surface is discharged in the image areas and charged in the non-image areas to record a discharged latent image thereon. Thereafter, the discharged latent image is developed by a developer unit, indicated generally by the reference numeral 100.

Developer unit 100 includes a donor roll 102, electrode wires 104 and a magnetic roll 106. The donor roll 102 can be rotated in either the (width) or (against) direction relative to the motion of belt 10. The donor roller shown rotating in the direction of arrow 108. Electrode wires 104 are located in the development zone defined as the space between photoconductive belt 10 and donor roll 102. The electrode wires 104 include one or more thin tungsten wires which are lightly positioned against donor roll 102. The distance between wires 104 and donor roll 102 is approximately the thickness of the toner layer on donor roll 102. The extremities of the wires are supported by the tops of end bearing blocks (not shown) which also support donor roll 102 for rotation. An electrical bias is applied to the electrode wires by a voltage source. An AC bias is applied to the electrical wires with the wires being at a DC bias. A voltage source electrically biases the electrode wires with both a DC potential and an AC potential. A DC voltage source establishes an electrostatic field between photoconductive belt 10 and donor roll 102.

In operation, magnetic roll 106 advances developer material comprising carrier granules and toner particles into a loading zone adjacent donor roll 102. The electrical bias between donor roll 102 and magnetic roll 106 causes the toner particles to be attracted from the carrier granules to donor roll 102. Donor roll 102 advances the toner particles to the development zone. The electrical bias on electrode wires 104 detaches the toner particles on donor roll 102 and forms a toner powder cloud in the development zone. The discharged latent image attracts the detached toner particles to form a toner powder image thereon. The toner particles in developer unit 100 are of a color other than black, for example, the toner particles may be red or blue. After the charged area latent image is developed with black toner particles and the discharged area latent image developed with toner particles of a color other than black, belt 10 advances the resultant toner powder image to transfer station DD. At transfer station DD, a sheet or document is moved into contact with the toner powder image. Thus, photoconductive belt 10 is exposed to a pre-transfer light from a lamp (not shown) to reduce the attraction between the photoconductive belt and the toner powder image. Next, a corona generating device 41 charges the sheet to the proper magnitude and polarity as the sheet is passed through photoconductive belt 10. The toner powder image is attracted from photoconductive belt 10 to the sheet. After transfer, a corona generator 42 charges the sheet to the opposite plurality to detack the sheet from belt 10. Conveyor 44 advances the sheet to fusing station EE.

One skilled in the art will appreciate that while developer unit 30 has been described as developing the charged area latent image with black toner particles and developer unit 100 with non-black toner particles, both developer units can develop the respective latent images with black toner particles with the toner particles from one of the developer units being magnetic and the toner particles from the other developer unit being non-magnetic. Moreover, one of the developer units may develop one of the latent images with non-black toner particles while the other developer unit develops the latent image with magnetic toner particles. In this way, the color reproduction machine 8 of the present invention may be used to produce a document having both magnetic and non-magnetic indicia thereon as well as documents having highlight color.

Fusing station EE includes a fuser assembly indicated generally by the reference numeral 46, which permanently affixes the transferred toner powder image to the sheet. Preferably, fuser assembly 46 includes a heated fuser roll 48 and a pressure roll 50 with the powder image on the sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the sheets are fed through a decurler 52. Decurler 52 bends the sheet in a first direction and puts a known curl in the sheet, and then bends it in the opposite direction to remove that curl.

Forwarding rollers 54 than advance the sheet to duplex turn roll 56. Duplex selenoid gate 58 guides the sheet to the finishing station FF or to duplex tray 60. At finishing station FF, sheets are stacked in a compiler to form sets of cut sheet. The sheets of each set are optionally stapled to one another. The set of sheets are then delivered to a stacking tray. In a stacking tray, each set of sheets may be offset from an adjacent set of sheets.

With continued reference to the FIG. 6, duplex selenoid gate 58 directs the sheet into duplex tray 60. Duplex tray 60 provides an intermediate or buffer storage for those sheets that have been printed on one side on which an image will be subsequently printed on the second, opposed side thereof, i.e. the sheets being duplexed. The sheets are stacked in duplex tray 60 face down on top of one another in the order in which they are being printed.

In order to complete duplex printing, the simplex sheets in tray 60 are fed, in seriatim, by bottom feeder 62 from tray 60 back to transfer station DD via a conveyor 64 and rollers 66 for transfer of the toner powder image to the opposed side of the sheet. Inasmuch as successive sheets are fed from duplex tray 60, the proper or clean side of the sheet is positioned in contact with belt 10 at transfer station DD so that the toner powder image is transferred thereto. The duplex sheet is then fed through the same path as the simplex sheet to be advanced to finishing station FF.

Sheets are fed to transfer station DD from secondary tray 68. Secondary tray 68 includes an elevator driven by a bi-directional AC motor. Its controller has the ability to drive the tray up or down. When the tray is in the down position, stacks of sheets are loaded thereon or unloaded therefrom. In the up position, successive sheets may be fed therefrom by sheet feeder 70. Sheet feeder 70 is a friction retard feeder utilizing a feed belt and take-away rolls to advance successive sheets to transport 64 which advances the sheets to rolls 66 and then to transfer station DD.

Sheets may also be fed to transfer station DD from the auxiliary tray 72. Auxiliary tray 72 includes an elevator driven by bi-directional AC motor. Its controller has the ability to drive the tray up or down. When the tray is in the down position, stacks of sheets are loaded thereon or unloaded therefrom. In the up position, successive sheets may be fed therefrom by sheet feeder 74. Sheet feeder 74 is a friction retard feeder utilizing a feed belt and take-away rolls to advance successive sheets to transport 64 which advances the sheets to rolls 66 and to transfer station DD.

Secondary tray 68 and auxiliary tray 72 are secondary sources of sheets. A high capacity feeder indicated generally by the reference numeral 76, is the primary source of sheets. High capacity feeder 76 includes a tray 78 supported on elevator 80. The elevator is driven by a bi-directional AC motor to move the tray up or down. In the up position, the sheets are advanced from the tray to transfer station DD. A fluffer and air knife directs air onto the stack of sheets on tray 78 to separate the uppermost sheet from the stack of sheets. A vacuum pulls the uppermost sheet against the belt 81. Feed belt 81 feeds successive uppermost sheets from the stack to a take-away drive roll 82 and idler rolls 84. The drive rolls and modular rolls guide the sheet onto transport 86. Transport 86 advances the sheet to roll 66 which, in turn, move the sheet to transfer station DD.

Invariably, after the sheet is separated from photoconductive belt 10, some residual toner particles remain adhering thereto. After transfer, photoconductive belt 10 passes beneath corona generating device 94 which charges the residual toner particles to the proper polarity. Thereafter, a pre-charge array lamp (not shown), located inside photoconductive belt 10 discharges the photoconductive belt in preparation for the next imaging cycle. Residual particles are removed from the photoconductive surface at a single cleaning station GG.

At the single cleaning station GG, residual toner particles are removed by a cleaning apparatus that includes an electrically biased cleaner brush 88 and two detoning rolls 90 and 92. The cleaner brush 88 rotates into cleaning contact with the photoconductive surface to remove and entrain mixed color residual toner particles. The detoning rolls 90, 92 then remove entrained mixed color residual toner particles from the brush 88. The mixed color residual toner particles on the reclaim roller 92 are subsequently scrapped off and deposited onto a reclaim auger 202 that then transports the mixed color residual toner particles out of the cleaning station GG and into the mixed color toners separation and recovery apparatus 200 of the present invention.

In accordance with the present invention, the mixture or mixed waste color residual toners removed from the image bearing surface are transported, for example, by the auger 202 directly from the cleaning station GG to the mixed color toner separation and recovery apparatus 200 (to be described in detail below) of the present invention. Alternatively, the mixed color residual toners can be collected from the auger 202 first into suitable waste containers (not shown) and then for subsequent delivery via an input aperture 206 (FIGS. 1 and 2) to the mixed color toner separation and recovery apparatus 200.

The mixed color toner separation and recovery apparatus of the present invention is based, in part, on a fact that toners of different colors tend to differ slightly one from another in charging characteristics. As such, it is possible to find a particular type of carrier beads that will triboelectrically attract and bind more readily with charged toner particles of one particular color than with charged toner particles of any other color. This therefore can enable effective separation or fractionation of a mixture of particles of at least two different color toners. It has been found experimentally that a binary mixture of charged particles of two different colors of toner can subsequently be separated based on this approach. Actual success of preliminary experiments indicated that a single two step fractionation method and apparatus in accordance with the present invention can be utilized as described below to substantially separate and recover separately the different toners in such a mixture.

In the preliminary experiments, toner particles of two different color toners, namely cyan (C) and magenta (M) toners, were utilized to verify the approach of the present invention. The C&M toners were selected from a CMYK set designed, for example, for a full color, hybrid scavengeless image-on-image process. The types of carrier beads used consisted of Hoeganaes 120 micron core beads coated, for example, with different blends of PMMA (PolyMethyMethAcrylate) and KYNAR Registered Trademark.

In a first preliminary experiment, a mixture of about 100 grams of a first type of carrier beads and of (C) and (M) toners was created. The toner concentration was deliberately kept low at 1.2% consisting of 0.6% of (C) toner, and 0.6% of magenta (M) toner. The mixture was then roll milled for about 45 minutes. The result was a well charged single phase "developer" type mixture that had no loose toner phase, but in which both the cyan (C) and magenta (M) toner particles were made to effectively adhere to the first type of carrier beads. It was clear from the single phase nature of the mixture, and from statistical reasoning that whatever charging differences existed between particles of the two different color toners (C)&(M), such differences could not be effectively exploited at the low 1.2% toner concentration of the mixture.

Therefore, a second such mixture was created with the first type of carrier beads coated with 100% PMMA, by increasing the toner concentration from 1.2% to a significant level, e.g. 8% consisting of 4% of (C) toner, and 4% of (M) toner. The mixture was again rolled milled. The resulting mixture in this case desirably consisted of two distinct phases. The first phase was a loose toner "only" mix of (C) and (M) loose toner particles, and the second phase was a toner coated carrier "developer" like phase, which under a microscope appeared bluish, and in which the carrier beads clearly appeared to be coated with cyan (C) toner particles.

Utilizing a second and different type of carrier beads that are coated by 48% of KYNAR Registered Trademark and 52% (PMMA), a third experiment also produced results in two phases. This time, however, the developer or toner coated carrier phase (the second phase) revealed that the carrier beads were almost exclusively coated with magenta toner particles, and that the first phase of loose toner particles was rich or made up principally of cyan toner particles.

From these preliminary experiments, it was concluded that in order to exploit effectively the differences in charging characteristics of different color toners, the combined concentration of the toners in a mix thereof, or at least the concentration of the toner to be separated, that is, developed or attracted out with carrier beads, must be significant. This means, for example, that the concentration should be greater than a concentration at which there is sufficient toner to coat, or form at least a monolayer on, the entire surface of each carrier bead.

These preliminary experiments also verified two phenomena that are necessary for the design and function of the preferred embodiments of the two stage apparatus 200 of the present invention to be described below. The first phenomenon verified is that the two phases referred to above, namely the second phase having carrier beads coated with particles of one type of color toner, and the first phase consisting of a mix of loose toner particles, respectively, show little affinity to each other. Thus, the phases will tend to separate easily from each other, even just under the influence of gravity. For example, after the extensive roll milling of mixtures above that yielded two phase results, a first phase of loose toner particles mix, and a second phase of toner coated carrier beads. It was then found upon opening the jar, that the two phases had immediately separated one from the other, just under the influence of gravity. The separation was such that the second phase consisting of toner coated carrier beads, went to the bottom of the jar, and the first loose toner mix phase, was on the top.

The second phenomenon verified is that unlike the second phase of toner coated carrier beads, the first phase consisting of a mix of loose toner particles only, readily formed a powder cloud, and thus could be removed easily by subjecting it to even a gentle airflow.

Figure 1:
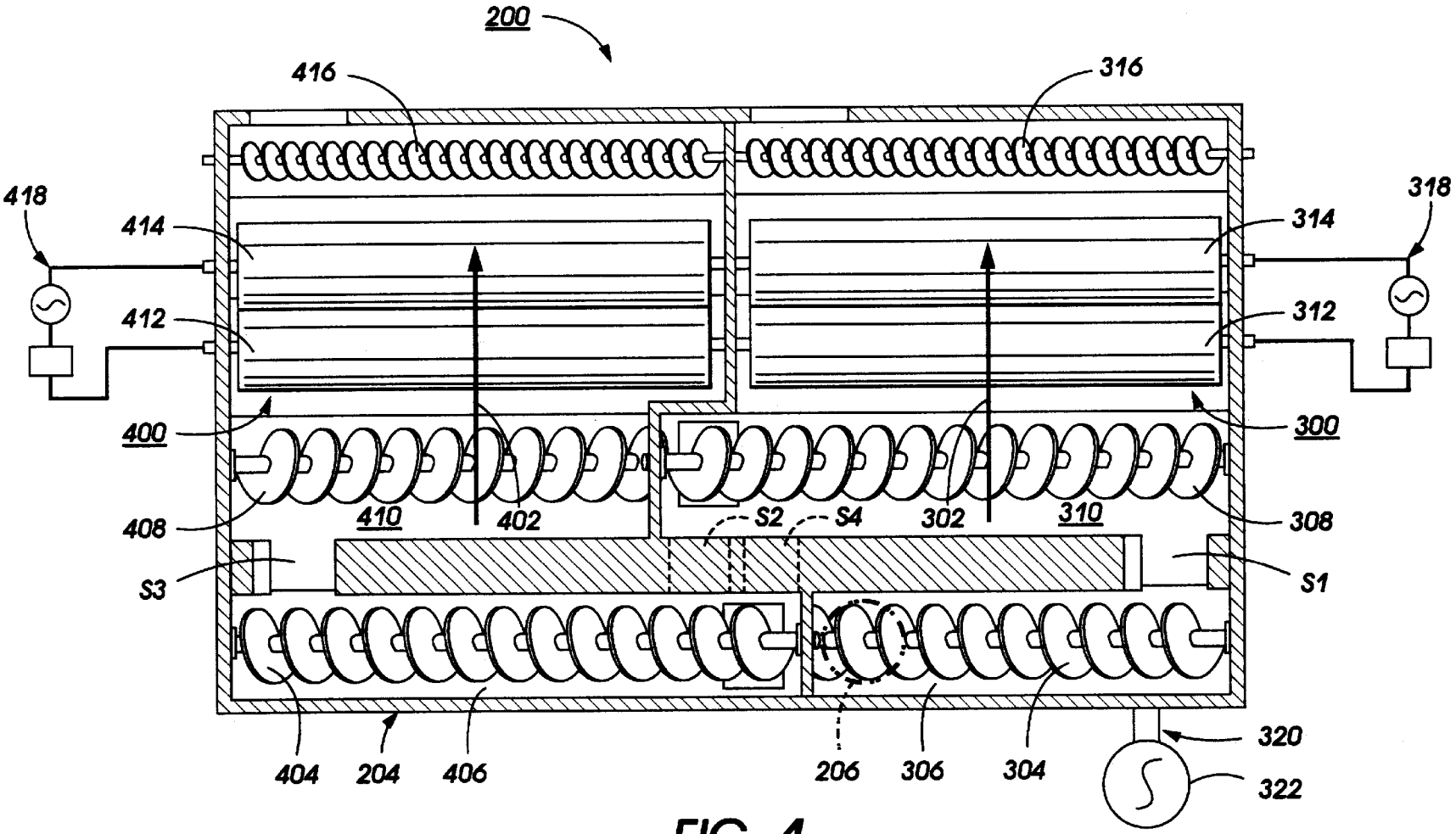
FIG. 1 is a top view (partly in section) of a first embodiment of the mixed color toners separation and recovery apparatus of the present invention.
Figure 2:
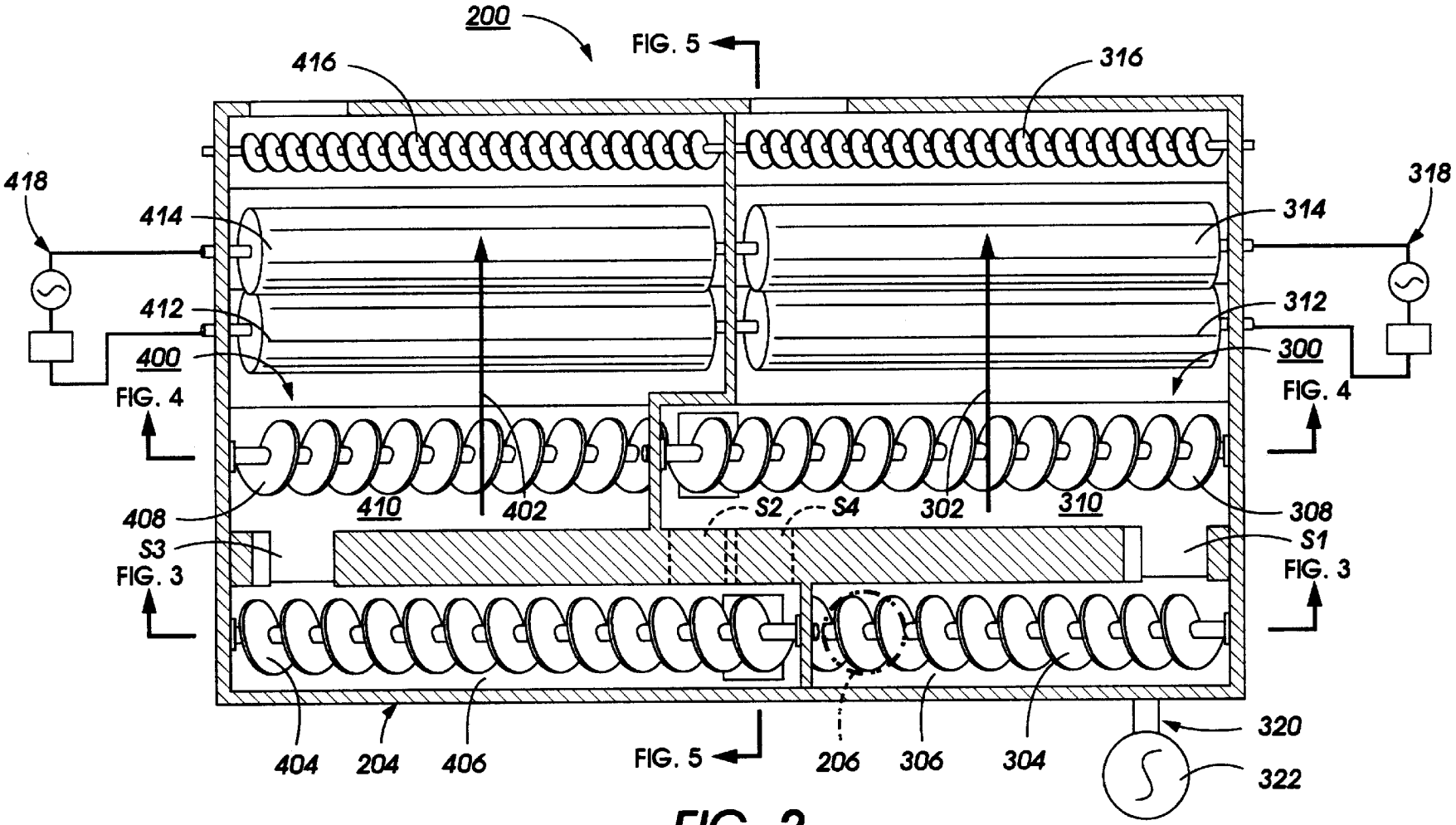
FIG. 2 is a top view (partly in section) of a second embodiment of the mixed color toners separation and recovery apparatus of the present invention.
Figure 3:
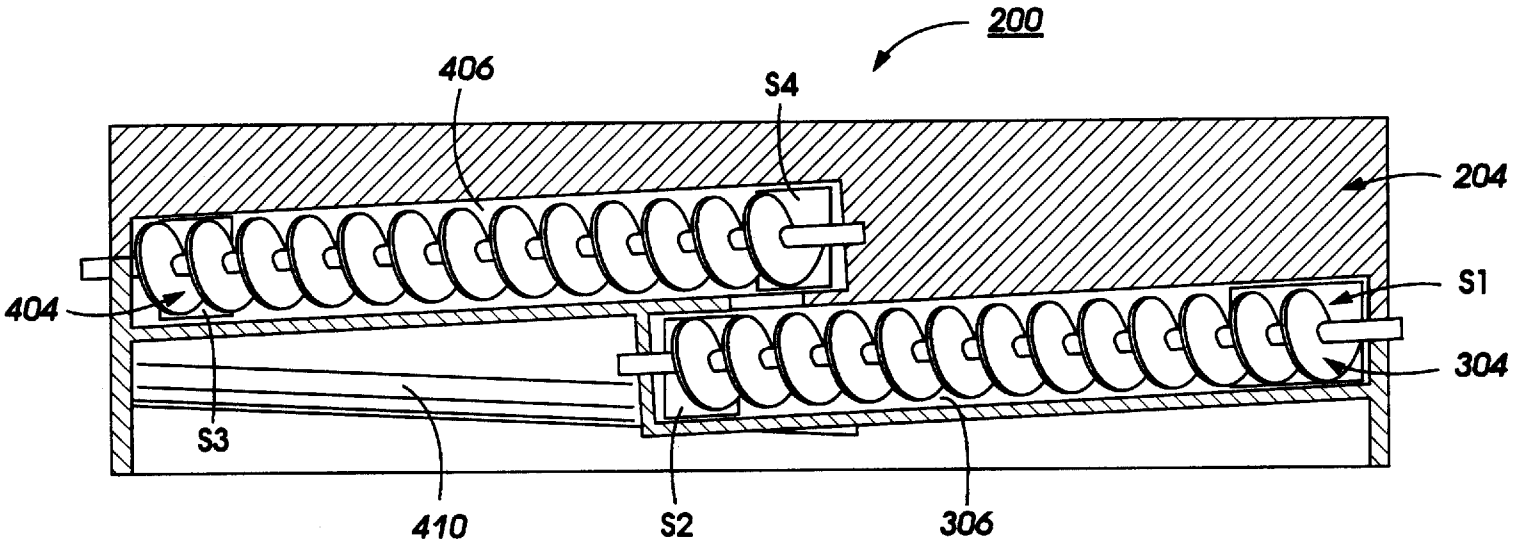
FIG. 3 is a vertical schematic of the apparatus of FIG. 2 taken along view plane 3—3.
Figure 4:
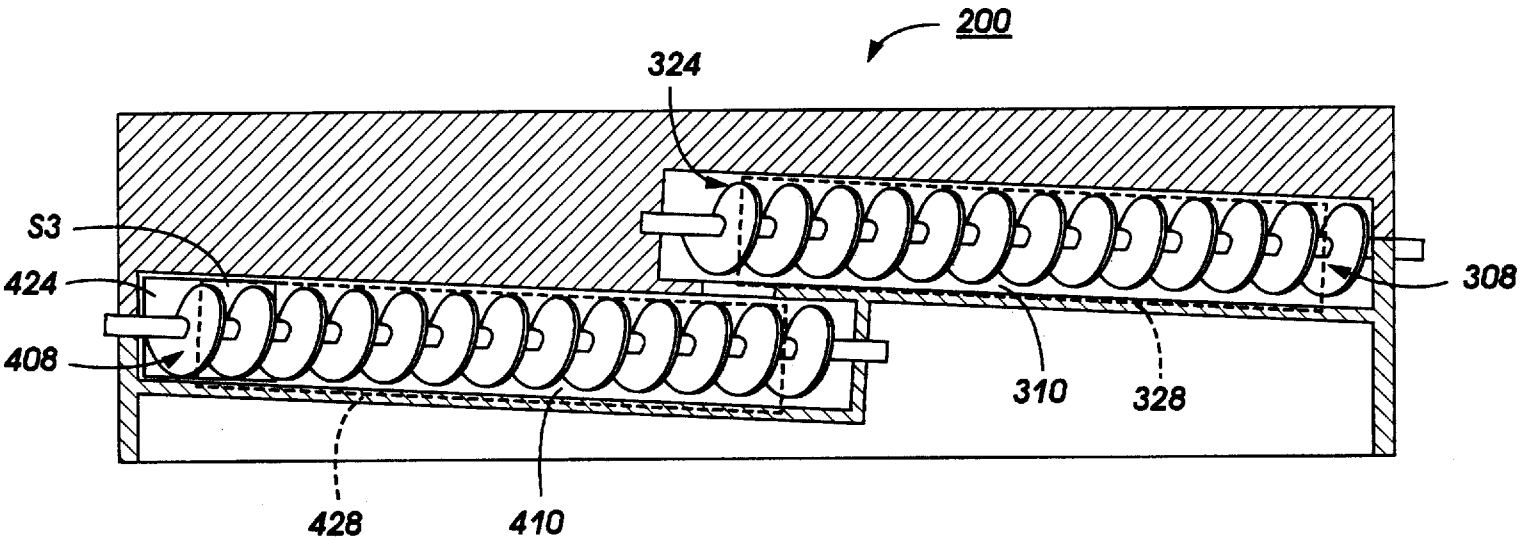
FIG. 4 is a vertical schematic of the apparatus of FIG. 2 taken along view plane 4—4.

Referring now to FIGS. 1 to 5, there is shown in greater detail embodiments of the mixed color toners separation and recovery apparatus 200 of the present invention. As shown in FIGS. 1 and 2, the apparatus 200 includes a housing 204 defining a mixture input aperture 206 for adding into the housing 204, a toner mixture containing toner particles T1 having a first color, and toner particles T2 having a second color. The housing 204 also defines a first stage 300 for separating and recovering, separately and in the direction of the arrow 302, toner particles T1 of the first color from a toner mixture added to the housing. The housing 204 further defines a second stage 400 for separating and recovering, separately and in the direction of the arrow 402, toner particles T2 of the second color from a toner mixture within the housing 204.

As shown, the first stage 300 includes a transport auger 304 mounted for rotation and for moving material, within a first channel 306, and a feeding auger 308 that is mounted for rotation and movement of material, within a second channel 310. The first and the second channels 306, 310 are in communication via slides or chutes S1 and S2 as shown. The first stage 300 also includes a rotatable magnetic roller 312 that is mounted adjacent and parallel to the feeding auger 308, an electrically biased and rotatable non-magnetic toner particles receiving roller 314 that is mounted adjacent and parallel to the magnetic roller 312, and a separated toner particles recovery auger 316. As shown, the receiving roller 314 is biased by a source 318 for inducing electrostatic transfer thereonto of toner particles from the magnetic roller 312. The mixture input aperture 206 is located advantageously in a position suitable for adding a mixture of mixed color toners containing T1 and T2 toner particles, onto the transport auger 304.

Importantly in accordance with the present invention, the first stage 300 includes a first type C1 of magnetic carrier beads that are contained in the first and second channels 306, 310, and that are isolated for movement only within the first stage 300. This first type C1 of magnetic carrier beads as such is moved around and around within the first stage, namely, from the first channel 306 via the chute S1 into the second channel 310, and back through the second chute S2 into the first channel 306. Where the toner particles T1 of the first color are cyan toner particles, the first type C1 of magnetic carrier beads have been found to preferably be coated with 100% PMMA. In general as discussed above, the first type C1 of magnetic carrier beads should be such that will triboelectrically charge, attract and bind more readily with the T1 toner particles of the first color, than with toner particles of any other color.

In operation, when a mixture of T1 and T2 toner particles is added through the input aperture 206 onto the transport auger 304, it settles into the first channel 306. Within the first channel 306, the mixture of T1 and T2 toner particles are moved by the transport auger 304 and mixed with carrier beads of the first type C1. Such moving and mixing causes the toner particles T1 to triboelectrically become attracted to the C1 carrier beads, thus forming a developer-like second phase mix, as experimentally verifed. Such moving and mixing continues as such mixture is moved via the chute S1 into the second channel 310. Within the second channel 310, the feeding auger 308, rotating preferably counterclockwise, moves and mixes the mixture, but also importantly feeds C1 magnetic carrier beads (that have attracted and become laden with T1 toner particles) to the rotating magnetic roller 312. T2 toner particles and any T1 particles not attracted by the C1 carrier beads within this second channel 310, remain therein as a loose toner first phase mix, as also verified experimentally above.

Accordingly, in the first stage 300, T1 toner particle coated carrier beads C1 are picked up by the counterclockwise rotating magnetic roller 312, and are transported as a magnetic carrier brush into a transfer nip or zone with the electrically biased, non-magnetic receiver roller 314. There, the toner particles T1 on the carrier beads C1 are transferred electrostatically from the carrier beads C1 onto the electrically biased receiver roller 314. Thereafter, the T1 toner particles on the receiver roller 314 are scraped by a first blade 332 onto the recovery auger 316 for recovery by separate transfer out of the housing 204. Meanwhile, magnetic carrier beads C1, thus partially depleted of T1 toner particles but still forming a magnetic brush on the magnetic roller 312, continue to rotate with the magnetic roller until detached by a second blade 334 and returned back onto the feeding auger 308 for recirculation to the first channel, and re-attraction of more appropriate T1 toner particles.

As shown, the second stage 400 includes a transport auger 404 mounted for rotation and for moving material within a first channel 406 therein, and a feeding auger 408 that is mounted for rotation and movement of material within a second channel 410. The first and the second channels 406, 410 are in communication via slides or chutes S3 and S4, as shown. The second stage 400 also includes a rotatable magnetic roller 412 that is mounted adjacent and parallel to the feeding auger 408, an electrically biased and rotatable non-magnetic toner particles receiving roller 414 that is mounted adjacent and parallel to the magnetic roller 412, and a separated toner particles recovery auger 416. As shown, the receiving roller 414 is biased by a source 418 for inducing electrostatic transfer thereonto of toner particles from the magnetic roller 412.

Importantly in accordance with the present invention, the second stage 400 includes a second type C2 of magnetic carrier beads that are contained in the first and second channels 406, 410, and that are isolated for movement within the second stage only. This second type C2 of magnetic carrier beads as such are moved around and around within the second stage, from the first channel 406 thereof via the chute S3 into the second channel 410, and back through the second chute S4 into the first channel 406. Where the toner particles T2 of the second color toner are magenta toner particles, the second type C2 of magnetic carrier beads have been found to preferably be coated with 48% of KYNAR Registered Trademark and 52% (PMMA). In general as discussed above, the second type C2 of magnetic carrier beads should be such that will triboelectrically charge, attract and bind more readily with the T2 toner particles of the second color, than with the T1 toner particles of the first color.

In the operation of the second stage 400, only a partial mixture consisting of T2 toner particles (and less T1 particles because T1 particles were developed out, or separated for recovery in the first stage 300) is moved into the second stage 400. Such a T2 enriched partial mixture is introduced into the first stage (as will be described below) first into the second channel 410 thereof for mixing and movement by the feeding auger 408 therein. Such moving and mixing causes the toner particles T2 to triboelectrically become attracted to the C2 carrier beads, thus forming a developer-like second phase mix, as experimentally verifed. The feeding auger 408, rotating preferably counterclockwise, importantly feeds the T2 coated C2 magnetic carrier beads (that have attracted and become laden with T2 toner particles) to the rotating magnetic roller 412. T1 toner particles and any T2 particles not attracted by the C2 carrier beads within this second channel 410, remain therein as a loose toner first phase mix, as also verified experimentally.

Accordingly, in the second stage 400, T2 toner particle coated carrier beads C2 are picked up by the counterclockwise rotating magnetic roller 412, and are transported as a magnetic carrier brush into a transfer nip or zone with the electrically biased, non-magnetic receiver roller 414. There, the toner particles T2 on the carrier beads C2 are transferred electrostatically from the carrier beads C2 onto the electrically biased receiver roller 414. Thereafter, the T2 toner particles on the receiver roller 414 are scraped by a second blade 432 onto the recovery auger 416 for separate transfer out of the housing 204. Meanwhile, magnetic carrier beads C2, thus partially depleted of T2 toner particles but still forming a magnetic brush on the magnetic roller 412, continue to rotate with the magnetic roller until detached by a second blade 434 and returned back onto the feeding auger 408 for recirculation to the first channel 406, and for re-attraction of more appropriate T2 toner particles.

Accordingly, in the two stage apparatus 200 of the present invention, the first stage 300 continuously is used for removing toner particles T1 of a first color, for example cyan (C) toner, and the second stage 400 continuously is used for removing toner particles of a second color, for example magenta (M) toner. The two stages 300, 400 are connected in such a way that the first type of carrier beads, C1 (in the first stage 300) and second type of carrier beads C2 (in the second stage 400) do not mix.

However, within each stage, while the toner coated carrier beads forming a second, developer-like phase therein are recirculated and fed out as above, the loose toner mix phase in each such stage must be removed and transported to the other stage. In accordance with the present invention, any of two different approaches may be utilized to remove the loose toner mix phase from one stage to the other. As shown particularly in FIGS. 1 and 5, for example, the first and preferred approach involves using a closed circuit air flow system 320. The closed circuit air flow system 320 can be used in any embodiment of the apparatus 200, but it is particularly useful in the first embodiment thereof as illustrated in FIG. 1. Note that FIGS. 1 and 2 represent two different embodiments of the apparatus 200 in which like reference numerals refer to like elements. The only difference between the FIG. 1 and FIG. 2 embodiments is that in FIG. 1, all the channels 306, 310, 316; 406, 410, 416 and all the rollers 312, 314; 412, 414 have a horizontal orientation within the housing 204, but as shown in FIGS. 2–5 they each have an inclined orientation (to be described in detail below).

Figure 5:
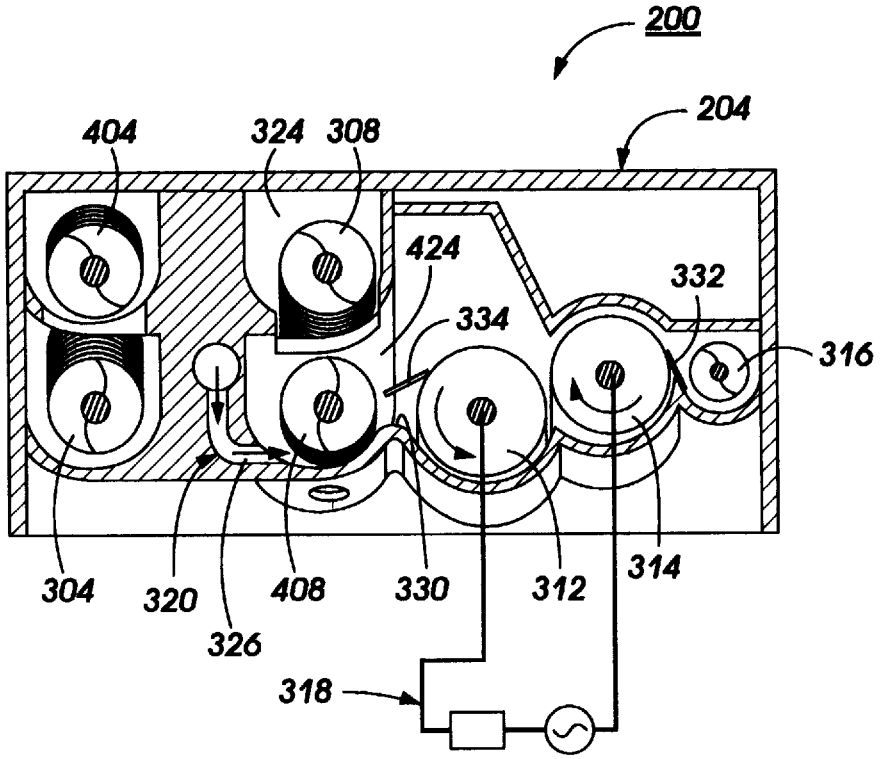
FIG. 5 is a vertical end view (partly insection) of the apparatus of FIG. 2 taken along view plane 5—5.

Referring now to FIGS. 1, 2 and 5, the air flow system 320 includes a source 322 of such air flow. As shown clearly in FIG. 5, the closed circuit air flow is drawn from an open space 324 above the feeding auger 308 of the first stage, and is moved through a conduit (426 not shown) and introduced into the bottom (428 not shown) of the feeding auger 408 of the second stage, thereby partially aerating and moving the mixture therein upwards. Similarly, the closed circuit air flow is drawn from an open space 424 above the feeding auger 408 of the second stage, and is moved through a conduit 326 and then introduced into the bottom 328 of the feeding auger 308 of the first stage, thereby also partially aerating and moving the mixture therein upwards. Partially aerating the mixture as such increases the mixing of carrier beads and attractable toner particles to form a developer-like phase two mix as verified experimentally. Additionally, with movement of the mixture upwards, loose toner particles therein that are not attracted to any carrier beads become airborne, thus forming a powder or toner cloud in the open spaces 324, 424 above the feeding augers 308, 408 respectively.

It is should be noted that the open space 324 above the feeding auger 308 of the first stage contains air laden principally with T2 toner particles since a substantial quantity of T1 toner particles (in the T1, T2 mixture of such particles), would have been separated or taken out (as a developer-like mix) by the magnetic roller 312 in the first stage 300. Such T2 laden air is thus introduced as above into the second stage 400 where the T2 toner particles will similarly be separated or taken out (as a developer-like mix) by the magnetic roller 412.

Similarly, the open space 424 above the feeding auger 408 of the second stage will contain air laden principally with T toner particles (if any) since T2 toner particles (in the principally T2 mix therein), would have been separated or taken out (as a developer-like mix) by the magnetic roller 412. Thus, when the first stage 300 develops out T1 toner particles, the air flow from the first stage 300 to the second stage 400, will carry a dense powder cloud of loose toner particles that is enriched in T2 toner particles. Then as described above, the second stage 400 will develop out the T2 toner particles, therefore the air flow from the second stage 400 back to the first stage 300 will be rich instead in T1 toner particles.

As verified experimentally, the toner coated carrier phase of the colored toner mix in each channel 306, 310 (first stage), and 406, 410 (second stage) substantially moves and segregates to the bottom of each such channel. On the other hand, the loose toner mix phase in each such channel principally remains or segregates to the top of the channel, except that any portion of it that is trapped by toner coated carrier beads.

In order to minimize the portion or quantity of the loose toner mix that is trapped or entrapped by toner coated carrier beads that being picked up by the magnetic roller 312, 412, the apparatus 200 is designed such that toner coated carrier beads are picked up from the bottom part of the second or feeding channel 310, 410 respectively of each stage. Thus, feeding augers 308, 408 as shown, each have to rotate counterclockwise for example, in order to be able to feed toner coated carrier to the bottom of the adjacent magnetic roller 312, 412, respectively. Accordingly, the rest of the rollers of the apparatus preferably also rotate counterclockwise, for example.

Rotation of the augers, for example the transport augers, moving the mixture in each stage is such as to cause the heavy toner coated carrier phase within each channel to follow the direction of rotation as much as gravity will permit. Consequently, the level of the toner coated carrier phase mix in each channel will rise just above a flange of the channel. As such, the flange between the second channel 310, 410 and the magnetic roller 312, 412 respectively of each stage can thus also serve as a trim bar 330, 430 for limiting a height of magnetic carrier beads attracted by the magnetic roller.

Accordingly, in the first stage 300, T1 toner particle coated carrier beads C1 are picked up by the counterclockwise rotating magnetic roller 312, and are transported as a magnetic carrier brush into a transfer nip or zone with the electrically biased, non-magnetic receiver roller 314. There, the toner particles T1 on the carrier beads C1 are transferred electrostatically from the carrier beads C1 onto the electrically biased receiver roller 314. Thereafter, the T1 toner particles on the receiver roller 314 are scraped by a first blade 332 onto the recovery auger 316 for separate transfer out of the housing 204. Meanwhile, magnetic carrier beads C1, thus depleted of T1 toner particles but still forming a magnetic brush on the magnetic roller 312, continue to rotate with the magnetic roller until detached by a second blade 334 and returned back onto the feeding auger 308 for recirculation to the first channel, and re-attraction of more appropriate T1 toner particles.

In each stage 300, 400, separated and recovered T1, T2 toner particles, respectively, may still be slightly contaminated, and therefore not sufficiently pure to be used as-recovered in a full color CMYK process, for example. Therefore, each recovered toner T1, T2 may need to be fed again into another fractionation stage containing appropriate carrier beads C1, C2 for redeveloping out the appropriate toner for that stage. This will insure a much higher degree of purity of the toners T1, T2 recovered in this stage.

It should be understood that the approach of the present invention for using a particular type of carrier beads in separating a mixture of two color types of toner particles T1, T2, can be used generally. Blending the carrier beads and the toner mixture results in two distinct phases, that allow for separation just by the influence of gravity. It is believed therefore that this approach enables carrying out the toner separation generally even in industrial powder handling applications. In such applications, mixed color toners will be admixed into an agitatable bed of a particular type of carrier beads so as to form two distinct phases as described above. The developer-like phase, consisting of particles of the appropriate toner coating the particular carrier beads, will collect at the bottom of the bed under the influence of gravity. The loose phase mix, consisting of loose, unattracted toner particles of the other types of toner in the admixture, will be left in the bed, and can then simply be blown out gently with air into another bed containing another type of carrier beads suitable for developing out toner particles of another type of toner contained in the loose phase mix from the previous bed.

Appropriate sieves, magnetic forces, and controlled airflow, individually, or in suitable combination, can then be used into each bed after the loose phase has been gently removed, to forcibly free the attracted, but separated type toner from the carrier beads. The results of such a continuous process are single color toners of acceptable color purity separately recovered from a starting mixture of all such single color toners.

To summarize, there has been provided an apparatus and method for separating and recovering separately toner particles of one matchable characteristic different color toner contained in a mixture of a plurality of such different color toners. The apparatus and method include a holder for holding a quantity of the mixture of a plurality of such different color toners, and a selected particular type of carrier beads characteristically matching, and being more likely to charge, attract and triboelectrically bind with, toner particles of a matching color toner in the mixture of the different color toners than with toner particles of any other color toner therein. The apparatus and method also include a blending device for forming, in the holder an admixture of a quantity of the mixture of the different color toners and a quantity of the selected particular type of carrier beads such that the admixture has a toner coated carrier phase and a loose toner particles phase, and such that the toner coated carrier phase consists of the selected particular type of carrier beads coated with toner particles of the matching one color toner of the different color toners of the admixture. The apparatus and method further include separating mechanisms for separating the toner coated phase from the loose toner particles phase, and a recovery mechanism for separating and removing, from the coated selected particular type of carrier beads of the toner coated phase, the toner particles of the matching one color toner.

There has also been provided an electrostatographic multicolor reproduction machine including a mixed color toner separation and recovery apparatus. The multicolor reproduction machine includes at least two development stations each containing toner particles of a different color for developing multicolor toner images; an image bearing surface for holding the multicolor toner images; a cleaning device for removing residual toner particles of at least two different types of color toners from the image bearing surface; and a two stage mixed color toners separation and recovery apparatus. Each stage of the mixed color toners separation and recovery apparatus includes a housing defining channels for holding material, a particular type of magnetic carrier beads matching, and being more likely to charge, attract and triboelectrically bind with, toner particles of a matching color toner in the mixture of the different color toners than with toner particles of any other color toner. Each stage also includes augers for forming, in the channels an admixture of a quantity of the mixture of the different color toners and a quantity of the particular type of carrier beads in the channel such that the admixture has a toner coated carrier phase and a loose toner particles phase, and such that the toner coated carrier phase consists of the particular type of carrier beads in the channel coated with toner particles of the matching one color toner of the different color toners of the admixture. Each stage further includes a magnetic mechanism and gentle flowing air for separating the toner coated carrier phase from the loose toner particles phase of the admixture, and a recovery mechanism for separating and removing, from the coated particular type of magnetic carrier beads of the toner coated carrier phase, the toner particles of the matching one color toner.

While this invention has been described in conjunction with a embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. Apparatus for separating and recovering separately toner particles of one matchable characteristic different color toner contained in a mixture of a plurality of such different color toners, the apparatus comprising:

(a) holding means for holding a quantity of the mixture of a plurality of such different color toners;

(b) a selected particular type of carrier beads characteristically matching, and being more likely to charge, attract and triboelectrically bind with, toner particles of a matching color toner in the mixture of the different color toners than with toner particles of any other color toner therein;

(c) blending means for forming, in said holding means, an admixture of a quantity of the mixture of the different color toners and a quantity of said selected particular type of carrier beads such that said admixture has a toner coated carrier phase and a loose toner particles phase, and such that the toner coated carrier phase comprises said selected particular type of carrier beads coated with toner particles of the matching color toner of the different color toners of the admixture;

(d) separating means for separating the toner coated carrier phase from the loose toner particles phase; and (e) recovery means for separating and removing, from the coated selected particular type of carrier beads of the toner coated carrier phase, the toner particles of the matching color toner.

2. A method of separating and recovering separately toner particles of one matchable characteristic different color toner contained in a mixture of a plurality of such different color toners, the method comprising the steps of:

(a) holding a quantity of the mixture of a plurality of such different color toners in a holding means;

(b) adding to the holding means a quantity of a selected particular type of carrier beads characteristically matching, and more likely to charge, attract and triboelectrically bind with toner particles of a matching color toner in the mixture of the different color toners than with toner particles of any other color toner therein;

(c) forming in said holding means an admixture of a quantity of the mixture of the different color toners and the quantity of the selected particular type of carrier beads such that the admixture has a toner coated carrier phase and a loose toner particles phase, and such that the toner coated carrier phase comprises the selected particular type of carrier beads coated with toner particles of the matching color toner of the different color toners of the admixture;

(d) separating the toner coated carrier phase from the loose toner particles phase; and (e) separating and removing, from the coated selected particular type of carrier beads of the toner coated carrier phase, the toner particles of the matching color toner.

3. A multiple stage apparatus for separating and recovering separately toner particles of each matchable characteristic different color toner contained in a mixture of a plurality of such different color toners, the multiple stage apparatus comprising:

(a) means defining a plurality of stages, said plurality of stages corresponding in number to a number of matchable characteristic different color toners contained in a mixture of the plurality of such different color toners; each stage of said plurality of stages including:

(i) holding means for holding a quantity of the mixture of a plurality of such different color toners;

(ii) a selected particular type of carrier beads characteristically matching, and being more likely to charge, attract and triboelectrically bind with, toner particles of a matching color toner in the mixture of the different color toners than with toner particles of any other color toner therein;

(iii) blending means for forming, in said holding means, an admixture of a quantity of the mixture of the different color toners and a quantity of said selected particular type of carrier beads such that said admixture has a toner coated carrier phase and a loose toner particles phase, and such that the toner coated carrier phase comprises said selected particular type of carrier beads coated with toner particles of the matching color toner of the different color toners of the admixture;

(iv) separating means for separating the toner coated carrier phase from the loose toner particles phase; and (v) recovery means for separating and removing, from the coated selected particular type of carrier beads of the toner coated carrier phase, the toner particles of the matching color toner.

4. The apparatus of claim 3, wherein said separating means for separating the toner coated carrier phase from the loose toner particles phase comprises a system of gentle blowing air for gently blowing the loose toner phase out of said holding means.

5. The apparatus of claim 3, wherein said selected particular type of carrier beads are magnetic and said separating means for separating the toner coated carrier phase from the loose toner particles phase includes magnetic means for removing toner coated magnetic carrier beads from the admixture.

6. The apparatus of claim 3, wherein said recovery means for separating and removing the toner particles of the matching color toner include electrostatic means causing toner particles to transfer from magnetic carrier beads to a recovery receptacle.

7. A mixed color toner particles separation and recovery apparatus comprising:

(a) a housing defining a first stage, a second stage, and a mixture input aperture for adding a toner mixture containing toner particles of a first color, and toner particles of a second color into said housing;

(b) a pair of first channels formed one in each of said first stage and said second stage of said housing, each first channel of said pair of first channels containing a mixture transport auger therein for moving a mixture of material;

(c) a pair of second channels formed one in each said first stage and said second stage of said housing, each second channel of said pair of second channels communicating with a corresponding first channel of said pair of first channels, and containing a mixture feeding auger therein for moving and feeding a mixture of material out of said each second channel;

(d) a first type of magnetic carrier beads contained in said each first and said each second channels of said first stage for triboelectrically attracting and becoming laden with toner particles of the first color contained in a toner mixture added to said housing;

(e) a second type of magnetic carrier beads contained in said each first and said each second channels of said second stage for triboelectrically attracting and becoming laden with toner particles of the second color contained in toner mixture moved into said second stage;

(f) a rotatable magnetic roller mounted, in each of said first stage and said second stage of said housing, adjacent and parallel to said mixture feeding auger therein for attracting and rotatably moving magnetic carrier beads laden with separated toner particles of the first color in said first stage and with separated toner particles of the second color in said second stage, respectively;

(g) a rotatable non-magnetic receiving roller mounted, in each of said first stage and said second stage of said housing, adjacent and parallel to said magnetic roller therein for receiving, from said magnetic roller, separated toner particles of the first color in said first stage and separated toner particles of the second color in said second stage, respectively; and (h) a recovery auger mounted, in each of said first stage and said second stage of said housing, adjacent and parallel to said non-magnetic receiving roller therein for recovering, from said non-magnetic receiving roller, separated toner particles of the first color in said first stage and separated toner particles of the second color in said second stage, respectively.

8. The apparatus of claim 7, including a scraper blade mounted against each said non-magnetic receiving roller for scraping separated toner particles of the first color in said first stage and separated toner particles of the second color in said second stage, respectively onto each said recovery auger.

9. The apparatus of claim 7, wherein said mixture input aperture is located in a position for adding toner mixture onto a mixture transport auger in said first stage.

10. The apparatus of claim 7, including separating means for separating, in each said second channel, a toner coated carrier phase from a loose toner particles phase of the mixture of material, said separating means including a system of gentle flowing air for gently blowing the loose toner phase out of each said second channel.

11. The apparatus of claim 7, including electric bias applying sources connected to said magnetic roller and said non-magnetic roller of each stage for electrostatically separating and removing the toner particles from toner coated carrier beads magnetically attached to each said magnetic roller.

12. An electrostatographic multicolor reproduction machine including a mixed color toner separation and recovery apparatus, the multicolor reproduction machine including at least two development stations each containing toner particles of a different color for developing multicolor toner images, the multicolor reproduction machine comprising:

(a) an imaging member having an image bearing surface for holding the multicolor toner images;

(b) a cleaning device for removing residual toner particles of at least two different types of color toners from the image bearing surface;

(c) and a two stage mixed color toners separation and recovery apparatus, wherein each stage includes:

(i) a housing defining channels for holding material;

(ii) a particular type of magnetic carrier beads matching, and being more likely to charge, attract and triboelectrically bind with, toner particles of a matching color toner in a mixture of the different color toners than with toner particles of any other color toner;

(iii) augers for forming, in each channel of said channels for holding material, an admixture of a quantity of the mixture of the different color toners and a quantity of the particular type of magnetic carrier beads in said each channel such that the admixture has a toner coated carrier phase and a loose toner particles phase, and such that the toner coated carrier phase consists of the particular type of magnetic carrier beads in each said channel coated with toner particles of a matching color toner of the different color toners of the admixture;

(iv) a magnetic mechanism and gentle flowing air for separating the toner coated carrier phase from the loose toner particles phase of the admixture; and (v) a recovery mechanism for separating and removing, from the coated particular type of magnetic carrier beads of the toner coated carrier phase, the toner particles of the matching color toner.

* * * * *